United States Patent [19]

Antone, II et al.

[11] Patent Number: 4,711,634

[45] Date of Patent: Dec. 8, 1987

[54] WALL OUTLET COVER PLATE ASSEMBLY

[76] Inventors: Wayne L. Antone, II, 89864 Terretorial Rd., Elmira, Oreg. 97437; Dennis C. Finnell, 26732 Patterson Dr., Monroe, Oreg. 97456

[21] Appl. No.: 926,334

[22] Filed: Nov. 3, 1986

Related U.S. Application Data

[63] Continuation-in-part of Ser. No. 822,835, Jan. 27, 1986, abandoned.

[51] Int. Cl.[4] ..... H01R 13/44

[52] U.S. Cl. ..... 439/136; 174/67

[58] Field of Search ..... 339/36, 40; 174/76

[56] References Cited

U.S. PATENT DOCUMENTS 2,988,242 6/1961 Kneip ..... 174/67

3,865,456 2/1975 Dola ..... 339/40

*Primary Examiner*—Gil Weidenfeld

*Assistant Examiner*—Paula A. Austin

*Attorney, Agent, or Firm*—James D. Givnan, Jr.

[57] ABSTRACT

A wall cover plate assembly having a face plate defining electrical plug receiving openings. A guide on the rear side of the face plate slidably confines independent closures each of which is biased to a closed portion by a tensioned member. The guide also defines openings through which the electrical plugs may be inserted. A modified form of cover plate assembly provides for securement of the guide by means of a mortise and tenon joint. A barrier overlying the rear side of the cover plate blocks air and sound from entering a room via an electrical outlet. Recessed closures also inhibit air and sound passage.

5 Claims, 10 Drawing Figures

WALL OUTLET COVER PLATE ASSEMBLY

BACKGROUND OF THE INVENTION

The present application is a continuation-in-part application of our patent application filed Jan. 27, 1986, under Ser. No., 06/822,835 and bearing the same title now abandoned.

The present invention pertains to wall outlet cover plates and specifically to such cover plates including closures for covering unused sockets in the wall outlet.

It is highly desirable to cover the electrical sockets of a wall outlet to prevent injury to young children who may be tempted to insert things into the outlet receptacles.

In the prior art are various devices directed toward preventing access to the outlet sockets. The most pertinent devices, to the extent the present inventors' knowledge, are found in U.S. Pat. Nos. 3,068,442; 2,728,894; 4,279,457; 4,228,317; 4,302,624. Of the foregoing patented devices, that device shown in U.S. Pat. No. 3,068,442 is of interest in that it discloses a guard positionable over a conventional cover plate with upper and lower closures of the guard having a single fingertip operated actuator. Insertion of a plug into the upper socket of a wall outlet however obstructs movement of both closures of the patented device and hence prevents use of the remaining socket of the outlet. Additionally, the device is of a relatively complex nature.

SUMMARY OF THE PRESENT INVENTION

The present invention is embodied in a wall cover plate with slidable closures for overlying the unused sockets of an electrical wall outlet.

A cover plate defines openings permitting plug access to the wall outlet sockets. Guide means on the wall side of the cover plate slidably confines independent closures which are each finger actuated to an open position. Shoulders on the closures facilitate finger actuation. Tensioned members are provided to bias the closures and are readily accessible should replacement be necessary.

Important objectives of the cover plate assembly include the provision of a cover plate providing the user with selectively actuated closures independently positionable to provide access to or close off a selected outlet socket; the provision of a cover plate assembly of low cost construction and one that may be refurbished by the user if necessary; the provision of a cover plate assembly which effectively closes off outlet sockets to infants and young children; the provision of a cover plate assembly which may be equipped with a barrier and recessed closures and hence prevents air passage past a wall outlet box.

DETAILED DESCRIPTION OF THE PREFERRED EMBODIMENTS

Figure 1:
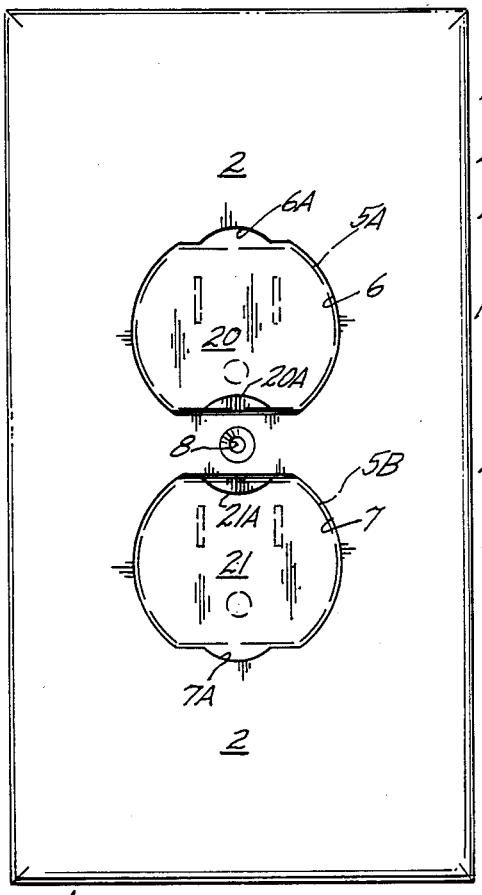
FIG. 1 is a front elevational view of the present cover plate.
Figure 3:
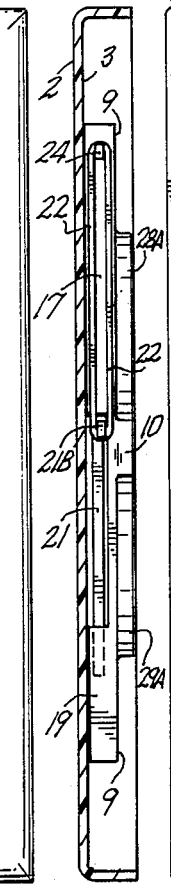
FIG. 3 is a vertical sectional view taken along line 3—3 of FIG. 2.
Figure 2:
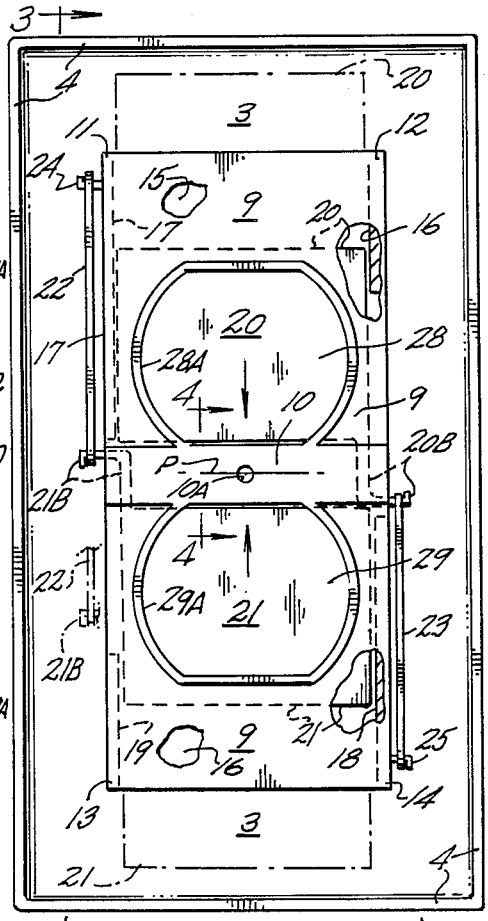
FIG. 2 is a rear elevational view of FIG. 1.
Figure 5:
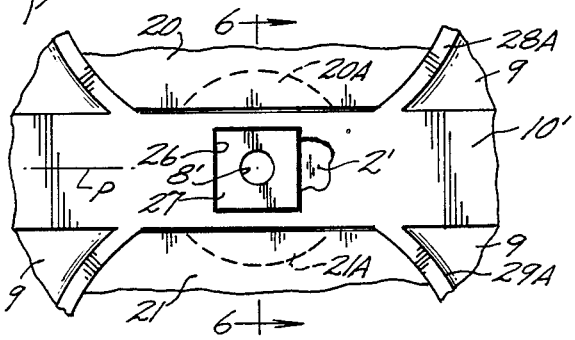
FIG. 5 is an enlarged fragmentary view of the rearward side of a modified cover plate.
Figure 4:
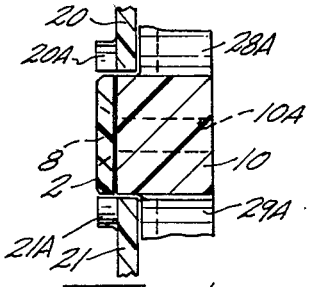
FIG. 4 is a vertical sectional view taken along line 4—4 of FIG. 2.
Figure 6:
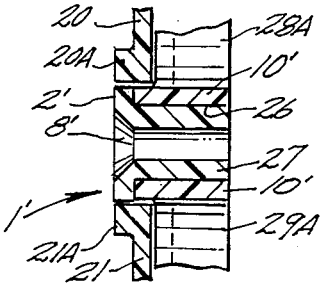
FIG. 6 is a vertical sectional view taken along line 6—6 of FIG. 5.

With continuing attention to the drawing wherein applied reference numerals indicate parts similarly hereinafter identified, the reference numeral 1 indicates generally a cover plate of the present cover plate assembly and having a front surface 2 and a rear surface 3.

The cover plate has a rearwardly extending perimetrical edge 4 for abutment with a room wall surface adjacent a conventional electrical wall outlet having sockets 5A–5B shown in phantom lines. The cover plate defines electrical plug receiving openings at 6 and 7. An opening 8 receives a mounting screw for threaded engagement with a threaded recess in the wall outlet box (not shown).

In place on the rearward or wall side of the face plate are guide means 9 which is of elongate configuration and secured at its corners 11, 12, 13 and 14 by suitable means to the rear surface 3 of the cover plate. Suitable means for securing said guide means to the cover plate include fusing same or gluing same at said corners. Other suitable means is hereinafter described.

Guide means 9 includes upper and lower guideways 15 and 16 defined respectively by pairs of guides 16-17 and 18-19. Confined between the pairs of guides and between the opposed, spaced apart surfaces of the face plate and guide means 9, are slidable closures 20 and 21 which normally close openings 6 and 7 in the face plate to overlie and conceal wall outlet sockets 5A-5B. Each slidable closure includes protruding shoulder surfaces 20A and 21A which facilitates finger opening of the closure.

The guide means 9 includes a centrally located transverse boss 10 against which the closures are biased as later explained. An aperture is at 10A. A pair of plug receiving openings 28 and 29 in guide means 9 are defined, on the plate rear side, by raised edges 28A-29A which seat about sockets 5A and 5B of the outlet to prevent entry of cold air therepast.

Each closure includes an arm as at 20B and 21B above which is engaged with the movable end of a tensionable member 22-23. The remaining or fixed ends of the tensionable members are passed about projections 24 and 25 on guide means 9. Tensionable member 22 which acts on closure 20 is located oppositely therefrom on the opposite side of a transverse medial plane P of the cover plate assembly. The same is true for tensionable member 23 and closure 21. If desired, helical springs with hook shaped ends may be substituted for the rubber bands. Accordingly, each sliding closure is independent from its companion closure. In use, when a closure is in the open position, the shoulder thereon 20A or 21A is received within a face plate recess at 6A or 7A whereby the closure may be displaced to fully open face plate opening 6 or 7 for unhindred plug insertion.

A modified cover plate assembly has a boss at 10' which defines a mortise at 26. A modified cover plate generally at 1′ includes a rearwardly projecting tenon 27 which frictionally engages mortise 26 in boss 10′ of the guide means to secure the boss and hence the guide means in place on the rear side of a cover plate 1′. A screw receiving opening is at 8′.

Figure 7:
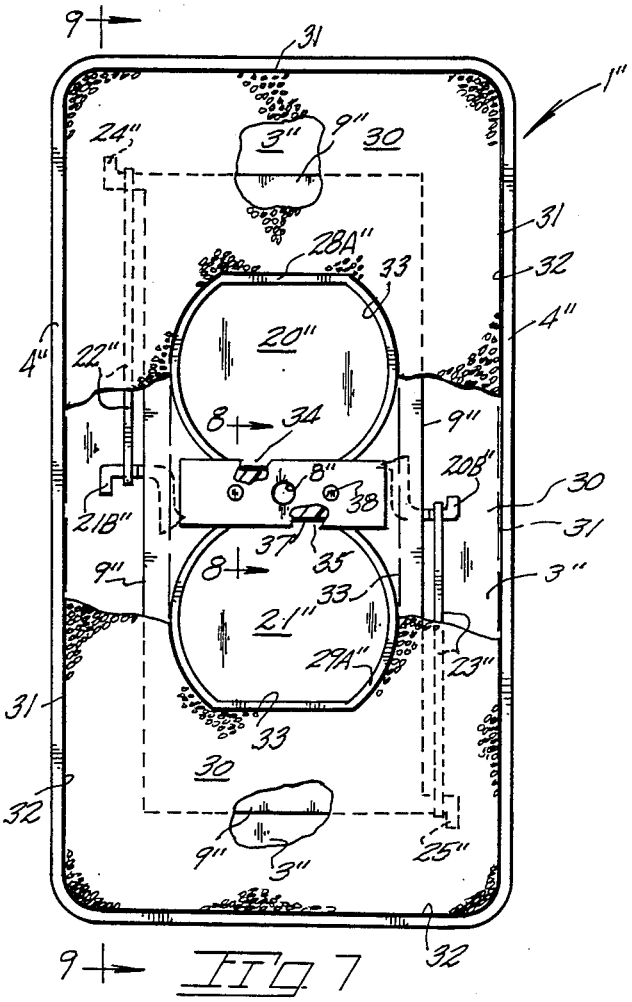
FIG. 7 is a rear elevational view of a modified cover plate with a barrier thereon.
Figure 8:
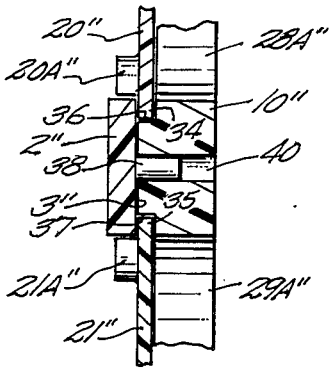
FIG. 8 is a vertical sectional view taken along line 8—8 of FIG. 7.
Figure 9:
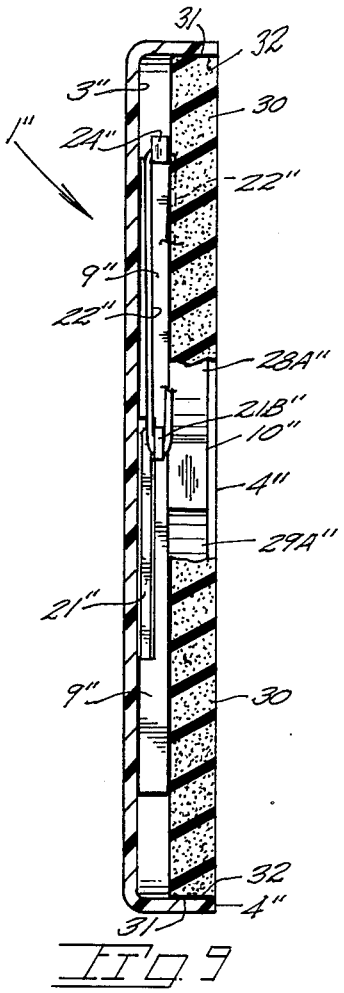
FIG. 9 is a vertical sectional view taken along line 9—9 of FIG. 7.
Figure 10:
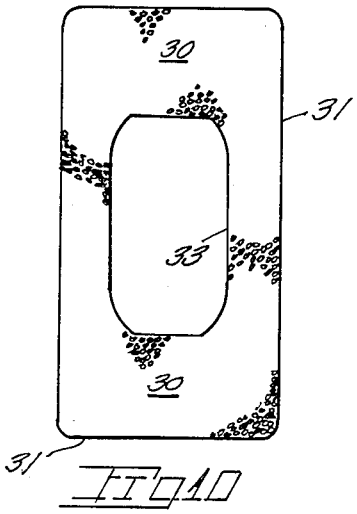
FIG. 10 is a plan view of the barrier removed from the cover plate.

A further modified cover plate assembly is indicated generally at 1″ in FIG. 7 and includes an air and sound barrier 30 in place on the rearward or wall mounted rear side of the plate assembly. Components of said further modified cover plate assembly are identified with double prime reference numerals and correspond to those parts earlier identified with like base reference numerals.

Barrier 30 is of a resilient nature and is supported in place on guide means 9″ and has a perimeter 31 which abuts a rim 32 of the cover plate. Barrier 30 has an inner edge 33 which defines an opening which fits snugly about raised edges 28A″ and 29A″ on guide 9″. Said raised edges, as in the earlier described forms of the invention, fit closely about the outlet sockets. Closed cell resilient foam material is suitable for the barrier material.

Closures 20″ and 21″ are slidably mounted within guide 9″ in the manner earlier described with the first described form of the cover plate. To inhibit air and sound passage past the closures, a lip at 34 and at 35 on each closure seats, in a recessed manner, against a shoulder at 36 and at 37 formed in a boss 10″. Cover plate 2″ also overlies the lips 34 and 35 to prevent air and sound passage past the opposed lip edges of the closures.

Cover plate 2″ is attached to guide means 9″ by a pair of pins 38 on the plate back or wall facing side 3″ which frictionally engages a pair of openings as at 40 in boss 10″ of guide means 9″.

While we have shown but a few embodiments of the invention, it will be apparent to those skilled in the art that the invention may be embodied still otherwise without departing from the spirit and scope of the invention.

Having thus described the invention, what is desired to be secured in a Letters Patent is:

1. A wall outlet cover plate assembly for attachment to a wall mounted electrical wall outlet having a pair of sockets, said cover plate assembly comprising in combination, a cover plate defining plug receiving openings, guide means in place on said cover plate and defining with said cover plate a pair of guideways.

closures for said plug receiving openings one each slidably confined in each of said guideways, said closures adapted for independent finger actuated sliding movement away from a transverse medial plane of the cover plate, and tensionable members having fixed and movable ends the latter coupled to each of said closures and biasing same toward said medial plane to close the plug receiving openings to the cover plate, the fixed end of each tensionable member being located on one side of said medial plane opposite from the closure biased thereby located on the remaining side of the medial plane.

2. The wall outlet cover plate assembly claimed in claim 1 wherein each of said closures include an arm to which the movable ends of the tensionable members are attached in a removable manner.

3. The wall outlet cover plate assembly claimed in claim 1 wherein said guide means includes raised edges which define a pair of openings which correspond to the outer periphery of each wall outlet socket to seat thereabout in an airtight manner.

4. The wall outlet cover plate claimed in claim 1 additionally including an air and sound barrier in place on said guide means and substantially occupying the wall mounted side of the cover plate.

5. The wall outlet claimed in claim 1 wherein said guide means defines recessed areas, said closures each having a transversely extending lip portion for disposition within one of said recessed areas when the closure is positioned by one of said tensionable members.

* * * * *